United States Patent [19]

DeHaven et al.

[11] Patent Number: 4,671,164

[45] Date of Patent: Jun. 9, 1987

[54] SHELL MAGAZINE FOR TANKS

[75] Inventors: Vernet F. DeHaven, Huron; Francis J. Warin, Oak Harbor, both of Ohio

[73] Assignee: ARES, Inc., Port Clinton, Ohio

[21] Appl. No.: 730,772

[22] Filed: May 3, 1985

[51] Int. Cl.[4] ..... F41H 7/06

[52] U.S. Cl. ..... 89/34; 89/45

[58] Field of Search ..... 89/33.17, 34, 36.13, 89/45, 46, 47

[56] References Cited

U.S. PATENT DOCUMENTS

| | | | |
|---|---|---|---|
| 1,298,091 | 3/1919 | Redpath et al. | 89/33.17 |
| 3,136,212 | 6/1964 | Girouard et al. | 89/45 |
| 4,457,209 | 7/1984 | Scheurich et al. | 89/34 |

FOREIGN PATENT DOCUMENTS

| | | | |
|---|---|---|---|
| 1578093 | 5/1971 | Fed. Rep. of Germany | 89/46 |
| 429369 | 9/1911 | France | 89/45 |
| 9548 | of 1896 | United Kingdom | 89/45 |

*Primary Examiner*—Stephen C. Bentley

*Attorney, Agent, or Firm*—Allan R. Fowler

[57] ABSTRACT

Shell magazine apparatus for tanks having a gun crew basket rotably mounted within a vehicle and having a cannon mounted to the basket comprises a primary shell magazine mounted in the gun crew basket and a secondary shell magazine mounted in the vehicle. The primary magazine includes a number of shell holding canisters pivotally mounted to a canister carrier rotatably mounted on a core. A Geneva drive incrementally rotating the carrier and canisters to sequentially position the canisters in a particular elevating position. A pressurized fluid cylinder is provided for pivoting a canister in the elevating position into a position from which a shell can be extracted by an associated shell loading apparatus. The secondary magazine comprises first and second drums rotatably mounted, side-by-side, in the vehicle rearwardly of the primary magazine when the gun crew basket is azimuthally zeroed. The first and second drums are orientated relative to the primary magazine so that shells can be then transferred forwardly, at particular rotational transport positions, into the primary magazine. A sensor and control system is provided for operating the magazine.

11 Claims, 7 Drawing Figures

SHELL MAGAZINE FOR TANKS

BACKGROUND OF THE INVENTION

1. Field of the Invention

The present invention relates generally to the field of shell feeding and loading apparatus for guns, particularly, of automated shell feeding and magazine apparatus for cannon.

2. Discussion of the Prior Art

Armored vehicles, in particular military tanks and mobile gun platforms, are widely considered, even in the nuclear age, to be the backbone of land-based military forces. As a result, there is a continual escalation in the development of improved and more survivable tanks and gun platforms on the one hand and in the development of improved and more potent anti-armor weapons on the other hand. In general, because of continual improvement in anti-armor weapons, modern tanks are constructed with more, and usually heavier, armor, which is turn usually results in the tanks being larger and more massive. This, in turn, generally requires larger and more powerful engines, transmissions and so forth, which require the tank to be still larger and more masssive. In addition, because of tanks being more heavily armored, the tanks are required to mount larger, and more powerful cannon to combat heavily armed enemy tanks.

As tanks become heavier and larger they tend to become more mechanically complicated and very greatly more costly to purchase, operate and maintain. Moreover, weight and size limits are reached which make the tanks difficult or impossible to air transport, and existing roads, bridges and other structures may not be sufficiently strong to support the tank's weight.

Still further, the increased size of heavily armored tanks of current design results in a relatively large target profile which tends, in and of itself to result in increased tank vulnerability to anti-armor weapons, thereby necessitating still more armor and still larger size. An additional consideration is that large tanks require relatively large tank crews and thus military manpower limitations alone may limit the number of large tanks that can be fielded.

As a rêsult of such factors, it is widely considered by many that present main battle tanks are about as large and massive as is practical and may, nevertheless, be vulnerable to enemy anti-armor weapons. Thus, there is a current emphasis in many countries of the world to produce smaller tanks which, while still being heavily armored to protect the crew, have smaller target profiles and which preferably have reduced crew requirements.

A factor which has contributed to the large size and comparatively high profile of modern tanks is that the tanks' cannon have typically been mounted within large, heavily armored turrets which also at least partially house a typical three man gun crew of gun commander, gun operator and gun loader. Height is ordinarily provided in the tank for the gun loader to stand upright to enable loading shells from a shell magazine into the gun.

In order to reduce tank size and profile height, numerous new tank designs eliminate the conventional massive gun turret, and instead, mount the cannon exteriorally on top of a relatively small armored vehicle. Since, in such designs, the cannon is outside the crew compartment, automated loading of the cannon is needed for transferring shells from a magazine located inside the armored vehicle upwardly into the cannon for firing. An important advantage associated with the provision of autoloading apparatus is that the previously-required gun loader is no longer required, thus reducing crew size. Furthermore, overall height of the tank can be reduced, in some instances by a significant amount, since head clearance for a standing shell loader crewman is no longer required and all crewmen in the tank can operate the vehicle and gun from a seated position.

The required autoloading apparatus for such externally mounted cannon are generally required to operate in a relatively restricted space and are typically required to move shells along a relatively complicated path from a magazine extraction position within the vehicle into the breech of the cannon. In addition, it is generally required that the autoloading apparatus operate in a reliable manner enabling comparatively rapid firing of the cannon. Furthermore, it is ordinarily required that the autoloading system have capablity for selectively feeding more than one type of shell to the cannon according to the type of target under firing attack.

Such autoloading apparatus are typically required to operate in conjunction with shell magazine apparatus which provides shells to the autoloader. Typically, in order to minimize complexity, autoloaders are configured for picking up shells from a fixed shell magazine position. As a result, magazine automation is required to transport shells held in the magazine into the autoloader pickup position.

The magazines associated with autoloading apparatus are required to supply a relatively large number of shells which, for tank calibre cannon of at least about 105 mm size, requires a substantial amount of space in the vehicle. Therefore, complex magazine apparatus may be required. For this and other reasons, improvements in shell magazine apparatus, especially for weapons systems in which a cannon is exteriorally mounted to a relatively small armored vehicle in which space is necessarily quite limited.

SUMMARY OF THE INVENTION

According to the present invention, shell magzine apparatus for guns comprises a plurality of shell holding canisters, preferably at least six and more preferably about nine, each of the canisters having a shell base end and a shell projectile end and a canister carrier and means for pivotally mounting the canisters to the carrier on a common circle and in a mutually spaced apart, side-by-side relationship. Preferably, projectile ends of the canisters are pivotally mounted to the carrier.

Means are included for mounting the canister carrier for rotation about a central rotational axis, as are means for causing incremental rotation of the canister carrier about the rotational axis so as to enable each of the canisters to be indexed, in turn, into a preselected canister pivoting position. Further included are means for causing pivoting of whichever canister is indexed into the pivoting position between a normal, retracted position and a elevated, shell extraction position. The canister pivoting means are configured for causing the canisters to pivot between the retracted and the elevated positions through a preferred angle of at least about 20 degrees. More preferably, the angle is between about 30 and about 60 degrees and most preferably the angle is about 36 degrees. Control means are provided for controlling the carrier rotating means and the canister elevating means.

According to an embodiment, means are provided for releasably locking each of the canisters in the retracted position and the means for causing canister pivoting include means for first unlocking the canister to be pivoted from the retracted position. Also, means are provided for releasably retaining shells received into the canisters, the shell retaining means being configured for releasing a shell held in a canister pivoted to the elevated position in response to engagement therewith by an associated shell loading apparatus which extracts shells from the canisters.

Further included in the shell magazine apparatus is at least one magazine drum configured for holding a plurality of shells and means for enabling the transfer of shells forwardly into rearward ends of the canisters from the drum when the canisters are axially aligned with shell holding recesses in the drum.

The canister pivoting means preferably include a plurality of pivot arms, one of the pivot arms being fixed to the shell projectile end of each of the canisters so that the pivot arms rotate with the canisters as the canister carrier rotates. Further included in the canister pivoting means are a fluid pressure cylinder and a piston moved by fluid pressure in the cylinder, between an extended position and a retracted position. Included is a slide connected to the piston, the slide having means for engaging the pivot arm of whichever one of the canisters is rotatably indexed into the canister pivoting position.

In conjunction with a vehicle having rotatably mounted therein a gun crew basket to which a cannon is externally mounted for azimuthal rotation therewith, the cannon being mounted to the basket so as to permit cannon barrel elevational movement, the canister carrier is rotatably mounted in the gun crew basket. A secondary shell magazine is disposed in the vehicle outside of the gun crew basket and means are provided for automatically transferring shells from the secondary magazine into the primary shell magazine canisters when the gun crew basket is rotated to a preselected azimuthal position in which a shell transfer position of the secondary magazine is aligned with one of the canisters of the primary shell magazine. Preferably, the means for rotatably mounting the canister carrier in the gun crew basket mounts the carrier for rotation about an axis which is in the elevational plane defined by the bore axis of the barrel of the cannon as the barrel is elevated relative to the gun crew basket and the longitudinal axis of a canister in the canister carrier specific rotational elevating position is in such elevational plane.

The secondary shell magazine preferably comprises a shell-holding cylinder having a plurality of shell holding ports located on a common circle, means being provided for mounting the cylinder for rotation about a longitudinal axis at the center of the common circle and for causing rotation of the cylinder about the longitudinal rotational axis on which the cylinder is mounted. In an embodiment of the invention, the secondary shell magazine includes first and second, similar shell-holding cylinders, each of the cylinders having a plurality of shell-holding ports located on a common circle and including means for mounting each of the cylinders in a side-by-side relationship on laterally separated longitudinal axes, the longitudinal mounting axis of the first cylinder being at the center of the circle on which the first cylinder ports are located and the longitudinal axis of the second cylinder being at the center of the circle on which the second cylinder ports are located. Each of the first and second cylinders has a separate, specific shell transferring rotational position from which shells from cylinder ports rotated into said shell transferring position can be transferred into canisters of the primary magazine when the canisters are rotated into the transferring positions. Preferably at least one of the first and second cylinders is formed having a second circle of shell-holding ports located inwardly from the first mentioned shell holding ports and therefore inwardly of the cylinder shell transfer position.

To enable manual loading of shells into the canisters of the primary magazine, at least one, and preferably all, of the canisters are longitudinally split into upper and lower clamshell segments, means being included for enabling manual opening of the upper segment relative to the corresponding lower segment so as to enable the manual loading of shells into the canisters.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
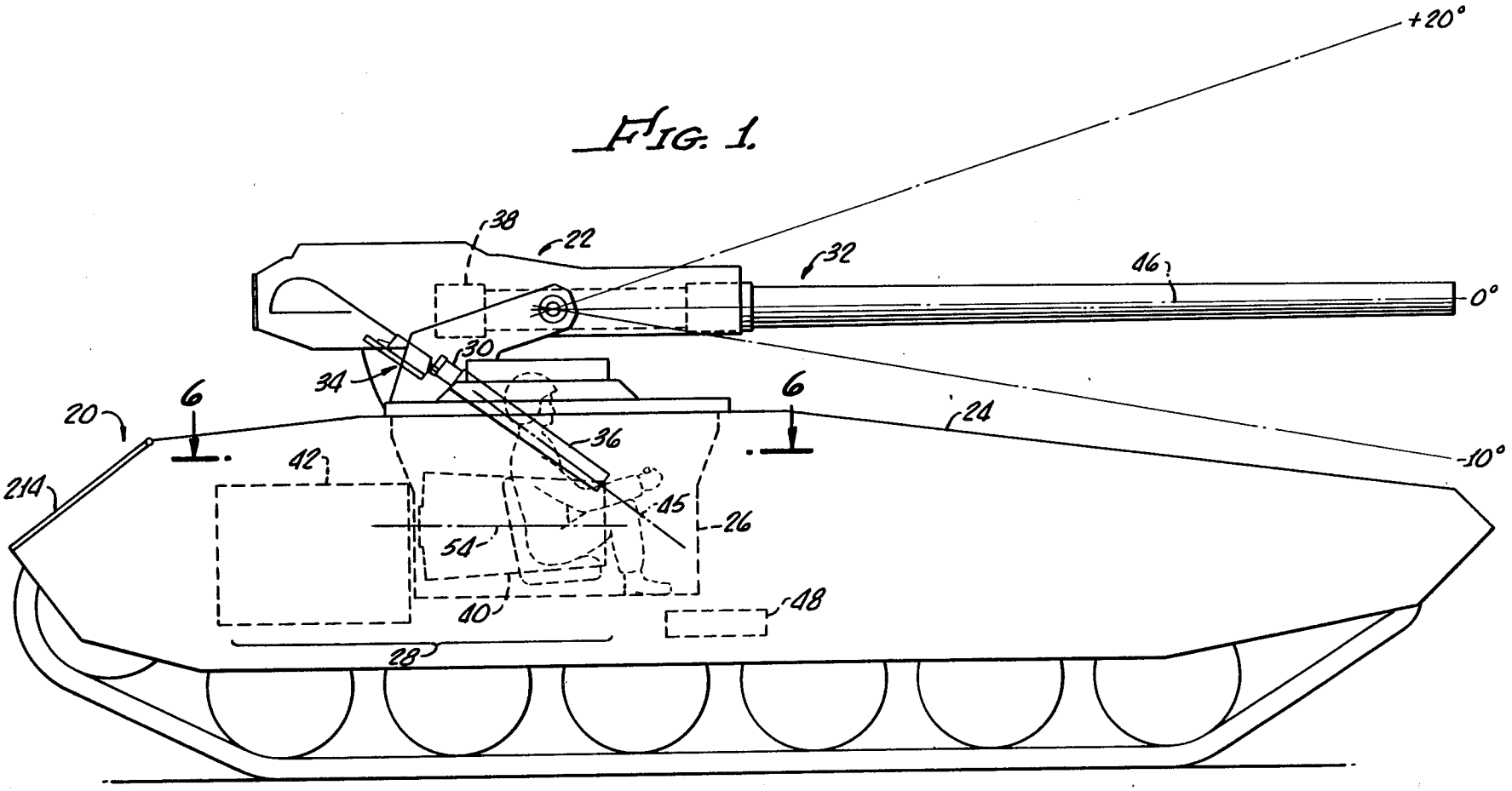
FIG. 1 is a side elevational view of an exemplary military tank having an externally mounted cannon with which the shell magazine apparatus of the present invention may be used to advantage.

A better understanding of the present invention may be had from the examination of FIG. 1 which depicts an exemplary military tank, mobile armored gun platform or the like 20 for which the present magazine invention is especially adapted. Comprising tank 20 is an external gun pod 22 and an armored vehicle 24, the vehicle having almost fully recessed therein a gun crew basket 26 which is mounted in the vehicle for azimuthal rotational movement, preferably through a full 360 degrees. Gun pod 22 is mounted to basket 26 for aximuthal rotation therewith and is mounted so as to enable limited elevational pivoting, for example, from about −10 degrees to about +20 degrees of elevation.

Disposed in vehicle 24 for protection by the vehicles armor, are shell magazine apparatus 38, according to the present invention. The function of magazine apparatus 28 is, of course, to store a quantity of shells 30 for firing by a cannon 32 mounted in gun pod 22. For an exemplary cannon 32 of 105 mm size, shell magazine apparatus may be configured, as described below, to contain 39 shells. However, it is to be understood that the present invention is not to be considered as limited to any particular shell size or number of shells, a shell size of 105 mm and a shell capacity of 39 shells being shown and described merely to illustrate the invention, and no limitations are thereby intended or implied.

Shown operatively associated with shell magazine apparatus 28 are automated shell loading apparatus 34. Such automated loading apparatus 34 is configured for picking up or extracting shells 30 from a shell magazine pickup or extraction position 36 and for then moving the extracted shell into a breech of cannon 32 for firing. Loading apparatus 34, however, forms no part of the present invention, it being a function of the present invention to move shells 30, in a serial manner, to pickup position 36 for extraction by some type of associated loading apparatus.

By way of specific example, again with no limitations intended or implied, automated shell loading apparatus 34 may be of the cam controlled type shown and diclosed in our copending patent application Ser. No. 774,160, filed on Sept. 9, 1985. It may be noted that such exemplary shell loading apparatus requires that cannon 32 be in a particular elevational position, for example, at zero degrees of elevation, in order for the loading apparatus to be properly oriented for extracting shells from magazine pickup position 36. However, such elevational zeroing of cannon 32 may not be necessary, or the cannon elevational position for loading may vary, for other types of shell loading apparatus. In any event, operation of shell magazine apparatus 28 is independent of cannon elevational position; some operational aspects of the magazine apparatus, as described below, are, however, dependent upon the azimuthal rotational position of basket 26 relative to vehicle 24.

Comprising generally shell magazine apparatus 28, more particularly described below, are a first, primary magazine portion or carousel 40 and a second, secondary magazine portion 42. As shown in FIG. 1, primary magazine portion 40 is mounted by brackets 44 within gun crew basket 26 and so moves in azimuthal rotation with the basket. As a result, primary magazine portion 40 always remains in a fixed azimuth rotational position relative to cannon 32. Moreover, shell magazine portion 40 is mountedly oriented in basket 26 so that a longitudinal axis 45 of a shell 30 in pickup position 36 is always in the vertical (when vehicle 24 is level) plane defined by a barrel bore axis 46 of cannon 32 as the cannon is pivoted in elevation. Consequently, shells 30 in shell magazine portion 40 are readily available to cannon 32, via automated shell loading means 34.

Secondary magazine portion 42 is, in contrast, mounted in vehicle 24 outside of basket 26. Primary magazine portion 40 threfore rotates azimuthally relative to secondary magazine portion 42 whenever, gun crew basket 26 is azimuthally rotated for aiming of cannon 32. As a result, shells 30 held in secondary magazine portion 42 are not readily available to cannon 32 and it is, therefore, the function of the secondary magazine position to hold a reserve supply of shells 30, which may, from time-to-time, be transferred into primary magazine portion 40 as the latter becomes depleted of shells. As described below, to enable the transfer of shells 30 from secondary magazine portion 42 into primary magazine portion 40 requires that basket 26 be azimuthally rotated relative to vehicle 24 to a specific rotational position in which transfer points of the two magazine portions are in alignment.

Because of limited space in basket 26 and the greater space available in vehicle 24 outside the basket, primary magazine portion 42 is configured to hold fewer shells 30 than are held by secondary magazine portion 42. In general, capacity of primary magazine 40 is intended to be sufficient for most combat firefights between which gun crew basket 26 could safely be rotated to the secondary magazine portion alignment position to enable replenishing of primary magazine portion 40 from the larger capacity. secondary magazine portion 42. By way of example, primary magazine portion 40 is shown and described below as holding nine shells 30 whereas secondary magazine portion 42 is shown and described as holding 30 shells.

Also as more particularly described, shell magazine apparatus 34 is controlled and operated by sensor and control means 48 (FIG. 2) which are conveniently located in vehicle 24 (FIG. 1). Described generally, sensor and control means 48 include a number of sensors which provide input information as to position of various moving parts of the overall weapons system. As example, the sensors may provide information as to whether a shell 30 in primary magazine portion 40 is in pickup position 36 and as to whether basket 26 is in the proper rotational position for shell transferring from secondary magazine portion 42 into primary magazine portion 40. In response to preprogrammed operational instructions and based on information from the sensors, sensor and control means 48 are responsible for executing commands relating to loading and firing of cannon 32. It is to be appreciated that sensor and control means 48 may be shared by shell magazine apparatus 28 with other portions of the weapons system, including automated shell loading apparatus 34, only portions of the sensor and control means directly related to the magazine apparatus being shown, however.

Primary shell magazine portion 40 is in the form of a rotary magazine or shell carousel which is mounted on a longitudinal rotational axis 54 (FIGS. 1 and 3) which is coplaner with pickup axis 45 and barrel bore axis 46. Comprising primary shell magazine portion 40 are a plurality of elongate, tubular shell holding canisters 56, forward ends of which are pivotally mounted to a cylindrical canister carrier 58 (FIGS. 3 and 4) which is, in turn, rotatably mounted, by bearing 59, on a non-rotating core 60. Canisters 56 are mounted in a close, side-by-side relationship on a common circle around canister carrier 58. The number of canisters 56 depends upon the diameter of the canisters (as determined by shell size) and the diameter of canister carrier 58 and for 105 mm shells the number of canisters may, for example, be nine, it, of course, being desirable that primary magazine portion 40 hold as many shells 30 as space considerations permit, with minimum capacity being about six.

Figure 4:
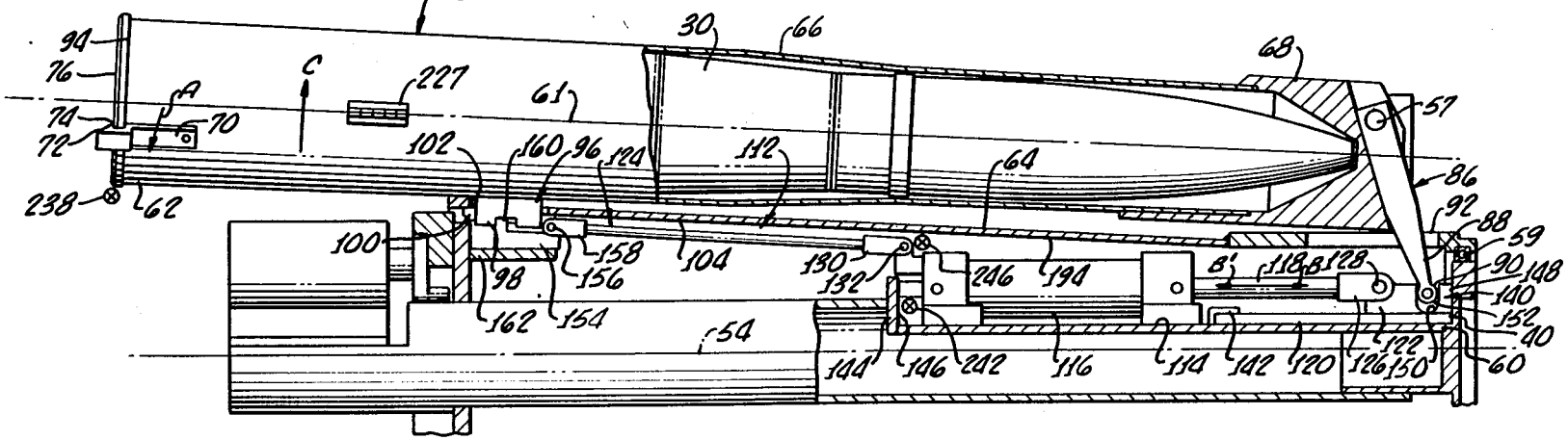
FIG. 4 is a longitudinal cross-sectional drawing, taken along line 4—4 of FIG. 2 showing canister elevating portions of the primary portion of the shell magazine.

As can be seen from FIG. 4, a longitudinal centerline or axis 61 of each canister 56 is, due to the tapered shape of the canisters to conform to the tapered shape of shells 30, not quite parallel to rotational axis 54, rearward ends of the canisters axes being slightly more distant from the rotational axes than are forward ends of the canister axes. It is, however, preferable, for ease of construction, that canister carrier 58 be of substantially uniform outside diameter and that carrier-facing regions of canister outer surface 62 abut an outer surface 64 of the carrier.

Each canister 56 comprises an elongate tapered, tubular sleeve 66 which is substantially closed at the forward end by a forward end member 68 into which the sleeve forward end is fixed. Length and inside diameters of canister sleeve 66 and end member 68 are sized to receive a shell 30, preferably in its entirety. Mounted to rearward portions of each canister 56 is a spring loaded shell retaining clip 70. A wedge shaped shell retaining end 72 on clip 70 enables a shell 30 being loaded into the rearward end of the canister 56 to push rearward portions of the clip outwardly (direction of Arrow "A", FIG. 4) to admit the shell into the canister. A clip end forward surface 74 abuts a shell base surface 76 when a shell 30 is fully inserted into canister 56 to retain the shell in the canister. To extract a shell 30 from canister 56, a nose portion of a shell rammer 78 forming part of shell loading apparatus 34 engages clip end 72 and thereby pushes the rearward end of clip 70 out of the shell removal path. Fixed to each canister forward end member 68, in radially outward regions thereof, is the outer end of elongate pivot arm 86. Inner end regions 88 of each pivot arm 86 extend through a aperture 90 formed through an outer wall 92 of canister carrier 58 adjacent each canister forward end member 68. Pivot arms 86 are used, as described below, for elevating whichever one of canisters is in a preestablished canister elevating position from a normal, retracted position into shell pickup position 36.

Fixed to inward facing regions of each canister sleeve 66, relatively adjacent to a rearward canister end 94, are canister latching means 96. Comprising canister latching means 96 is a latch bracket 98 which is mounted to canister surface 66 and a spring-loaded latching member 100, which is slidingly disposed in the bracket. An aperture 102 is formed through canister carrier wall 94 adjacent each canister latching means 96 for receiving therethrough latch bracket 98. When canister 56 is lying along carrier wall 94 and latch bracket 98 is received through carrier wall aperture 102, rearwardly projecting latch 100 bears against an inner surface 104 of carrier wall 94 to thereby lock the canister in the retracted position to canister carrier 58. In such manner all canisters 56 are normally locked in the normal, retracted position to canister carrier 58 and remain so locked in the retracted position, whether or not the carrier remains stationary or is being rotated about axis 54 until unlatched.

Canister unlatching and elevating means 112 (FIG. 4) are mounted to an outer surface 114 of core 60 at the preestablished canister elevating position. Comprising unlatching and elevating means 112 are a pressurized fluid cylinder 116, having axially extending from a forward end thereof a piston 118; an elongate cylinder mounting rail 120 which is fixed to core surface 114 parallel to core axis 54, a pivot arm engaging block 122 and a canister latch engaging arm 124. A forward clevis end 126 of piston 118 is pivotally connected by a pin 128 to rearward regions of block 122. A forward clevis end 130 of latch engaging arm 124 is pivotally connected, by a pin 132, to upper, rearward regions of cylinder 116.

As shown in FIG. 4, cylinder 116 and block 122 are slidably mounted on rail 120 for forward and rearward sliding movement (direction of arrows B—B') relative to the rail and also relative to canister carrier 58 which is, as above mentioned, rotatably mounted around core 60 to which the rail is fixed. To retain cylinder 116 and block 122 on rail 120, the rail may be T-shaped and T-shaped slots may be provided on the cylinder and block in a known manner (not shown). Fixed to, or forming a part of, rail 120 forwardly of block 122 is a first stop 140, a second stop 142 is fixed to rail 120 forwardly of a forward end of cylinder 116. Rearward movement of cylinder 116 along rail 120 is limited by an outwardly projecting core portion 144 having a forward facing surface 146.

Stops 140 and 142 and core surface 146 are relatively positioned so that when a forward surface 148 of block 22 is at forward stop 140, a "U"-shaped recess 150 formed downwardly into the block is longitudinally positioned for receiving thereinto an arcuate lower end 152 of pivot arm inner end portion 88 of whichever canister 56 is indexed into the preestablished canister elevating position defined by location of canister unlatching and elevating means 112. In a similar manner, when cylinder 116 is fully rearwardly on rail 120 so as to abut surface 146, a latch releasing element 154, which is pivotally mounted, by a pin 156, to a rearward clevis end 158 of arm 124 is received into a recess 160 formed upwardly in latch bracket 98 of whichever canister 56 is in the canister elevating positin (a guide 162 mounted to core 60 is provided for supporting arm 124). Stated otherwise, when cylinder 116 is fully rearward and block 122 is fully forward on rail 120 and canister carrier 58 is rotated so as to index one of canisters 56 into the canister elevating position shown in FIG. 4, lower end 152 of the canister mounted pivot arm 86 moves into block recess 150 and recess 160 in latch bracket 98 moves into registration with latch release element 154.

It is to be observed from FIG. 4 that for cylinder 116 to be fully rearward and for block 122 to be fully forward on rail 120, pressurized fluid is applied to cylinder 116 so as to cause piston 118 to move forwardly, relatively to the cylinder, the maximum amount permitted by stop 140 and surface 146. Application of pressurized fluid to cylinder 116 so as to cause rearward retraction of piston 118 into the cylinder first (due to the different loads provided) causes cylinder 116 to be pulled forwardly (direction of arrow B), thereby causing latch 100 to be released by release element 154. Cylinder 116 is pulled forward in this manner to second stop 142. Thereafter, continued retraction of piston 118 into cylinder 116 pulls block 122 rearwardly (direction of Arrow B') thereby pulling inner end regions 90 of pivot arm 86 rearwardly. In response to such rearward movement of pivot arm inner end region, pivot arm 86 causes upward pivoting (direction of Arrow C) of the unlatched canister about mounting rim 57 from the normal, retracted position into the elevated, shell pickup position 36 (FIG. 1). To retract the elevated canister 56 to the normal position, fluid pressure is applied to cylinder 116 to cause piston 118 to be extended therefrom, pushing block 122 back forwardly to cause reverse pivoting of the canister about pin 57 to the retracted position. Arm 124 is moved rearwardly to permit canister 56 to automatically relatch (by latch 100 being ramp shaped) to canister carrier 58. Canisters 56 are preferably elevated at least about 20° and more preferably between about 30° and about 60° with an elevational angle of about 36° being typical. It is, however, to be appreciated that the particular elevating angle required depends upon many factors, such as configuration of shell loading means 34.

Figure 5:
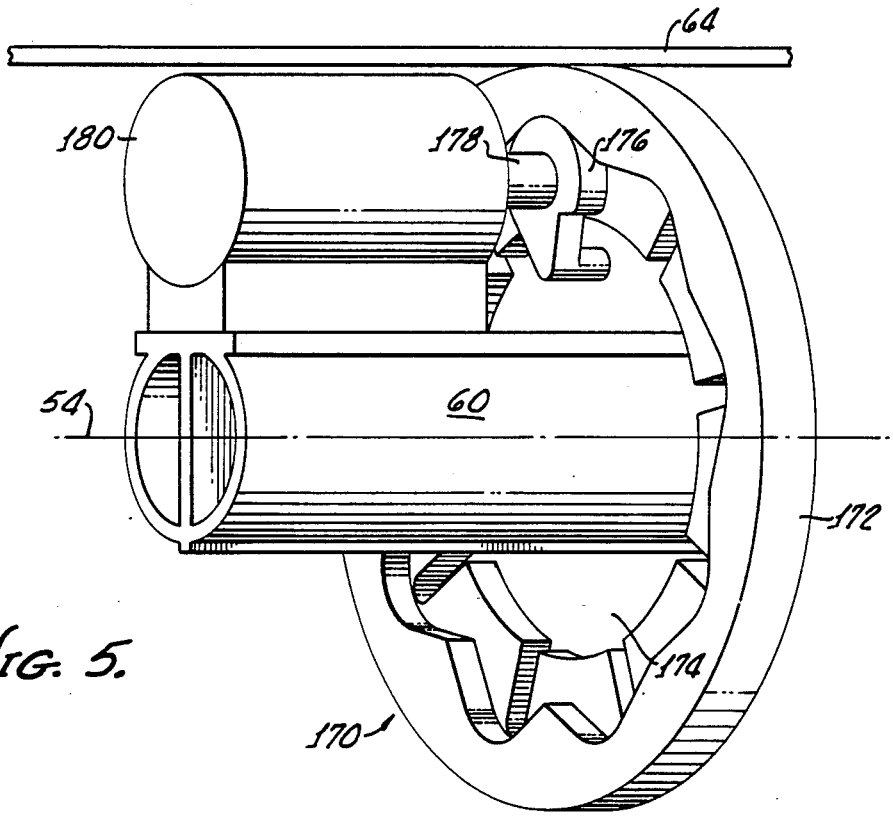
FIG. 5 is a rearward end view of the magazine primary portion showing means for indexing such portion.

Rotational indexing of canister carrier 58 relative to core 60 is provided, as shown in FIG. 5, is by conventional Geneva drive means 170. Included in Geneva drive means 170 is a circular Geneva drive plate 172 fixed to the inside of canister carrier 58 and having a central aperture 174 which provides clearance around core 60 to enable rotation of the plate. Also included in drive means 170 is a Geneva driver 176 which is fixed to a forwardly projecting drive shaft 178 of a drive motor 180, the drive motor being fixed to core 60 rearwardly of plate 172. Drive motor 180 is preferably of a pressurized fluid type.

Geneva plate 172 and driver 176 are configured in a well known manner to prove incrementary rotary indexing of canister carrier 58 about axis 60 so as to rotatably advance the carrier one shell canister position with each 360° rotation of drive motor shaft 178. Accordingly for the above-described, exemplary primary magazine portion 40 having nine canisters 56 mounted to canister carrier 58, each 360° revolution of drive motor shaft 178 causes a 40° rotation of Geneva plate 172 and hence of the canister carrier. Drive motor 180 and Geneva plate 172 are oriented so that at each such 40° rotational step of the Geneva plate, one of the canisters 56 is aligned with unlatching and elevating means 112. As previously mentioned, the longitudinal axis of whichever canister 56 is aligned with unlatching and elevating means 112 is in the elevational plane of barrel bore axis 46; as a result, axis 45 through shell pickup position 36 is also in the bore axis elevational plane.

Figure 7:
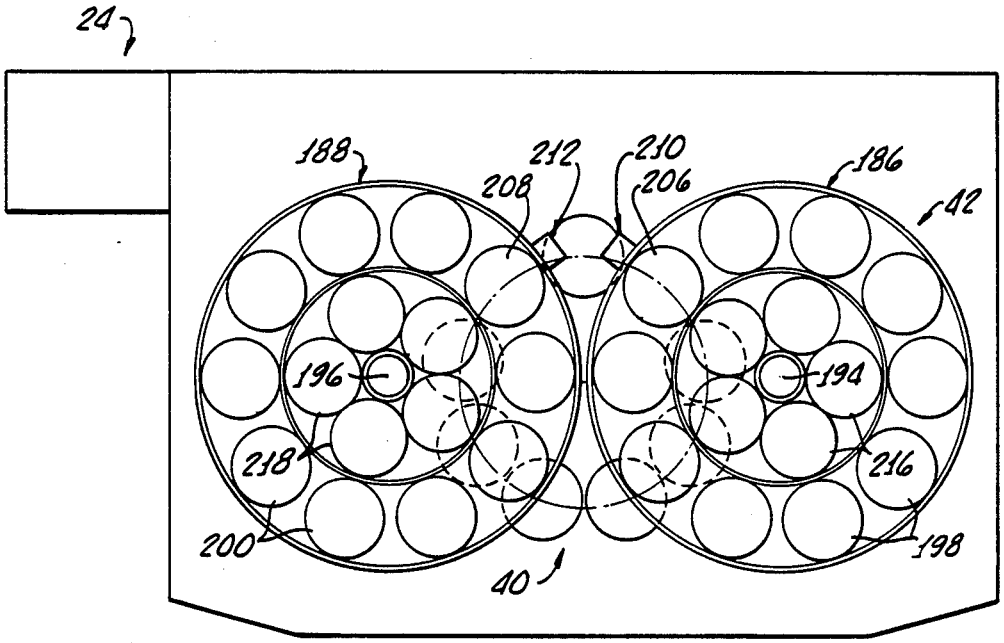
FIG. 7 is a view, taken along line 7—7 of FIG. 6 showing the rearward end of the first and second shell transfer drum.
Figure 6:
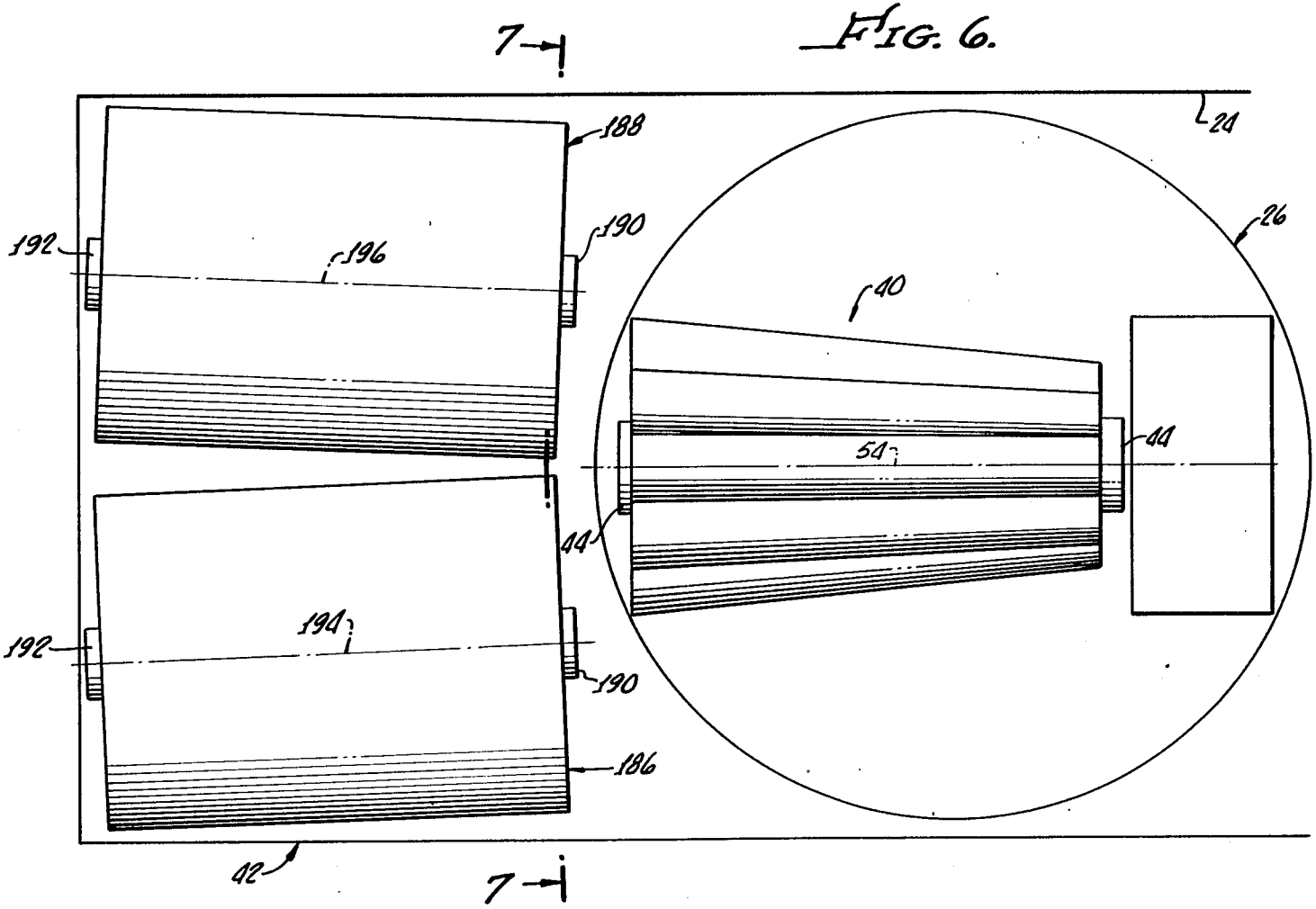
FIG. 6 is a plan view taken along line 6—6 of FIG. 1 showing the primary portion of the magazine apparatus and showing first and second shell transfer drums from which shell may be transferred into the primary portion.

As shown by FIGS. 6 and 7, secondary magazine portion 42 comprises first and second ammunition drums 186 and 188, respectively, which are mounted, by brackets 190 and 192 to structure of vehicle 24 rearwardly adjacent gun crew basket 26. Drums 186 and 188 are mounted in a side-by-side relationship, first drum 186 being rotatably mounted by brackets 190 for rotation about a longitudinal first drum axis 194 and second drum 188 being rotatably mounted by brackets 192 for rotation about a longitudinal second drum axis 196. A plurality (ten being shown in FIG. 7) of longitudinally-oriented shell holding apertures 198 are provided in first drum 186 on a common circle around rotational axis 194. A similar member of longitudinally-oriented shell holding apertures 200 are provided in second drum 188 on a common circle around second drum axis 196.

First and second drums 186 and 188 are oriented relative to one another and to first magazine portion 40 so that when gun crew basket 26 is azimuthally rotated to a preestablished shell-transferring azimuth position and canister carrier 58 is included in Geneva drive means 170 in the above-described manner, one of the first drum shell holding apertures 198 can be axially aligned with one of the canisters 56 and one of the second drum shell-holding apertures 200 can be axially aligned with another one of the canisters. Thus, as shown in FIG. 7, a first shell transfer position 206 is associated with first drum 186 and an opposing, second shell transfer position 208 is associated with second drum 188.

Accordingly, to load shells 30 from first drum 186 into primary magazine portion 40, canister carrier 58 is rotated, by drive means 170, until an empty canister 56 is aligned with first transfer position 206. First drum 186 is then rotated, for example, by a Geneva drive means (not shown) similar to Geneva drive means 170 until a loaded aperture 198 is at the first transfer position. A shell 30 in the aligned aperture 198 is then moved forwardly, for example, by a first pressurized fluid operated rammer means 210 associated with first drum 186. In an analogous manner, shells 30 are transferred, by a second rammer means 212 associated with second drum 188, when a shell containing aperture 200 of second drum is rotated into second transfer position 208 and canister carrier 58 is rotated until an empty canister 56 is aligned with such transfer position.

From the above description of primary magazine portion 40 it is seen that longitudinal axes of canisters 56 are not parallel with canister carrier rotational axis 54. Assuming, as is preferred, that longitudinal axes of shell holding apertures 198 and 200, respectively, of first and second drums 186 and 188 are parallel to respective rotational axes 194 and 196. it can be appreciated that to orient the two drums so that first and second transfer positions are aligned with canisters 56 drum rotational axis 54 will not be parallel with one another or with canister carrier axis 54. Nor will it normally be the case that the three axes 54, 194 and 196 will be coplanar; although axes 194 and 196 may be in a common plane.

Shells 30 may be retained in first drum apertures 198 and in second drum apertures 200 by spring-loaded detents (not shown) which prevent accidental movement of the shells from the apertures but which permit shells to be forwardly loaded into rearward ends of the apertures and to be forwardly transferred into canisters 56 from forward ends of the apertures.

Rearward access to first and second drums 186 and 188, for the loading of shells thereinto from outside vehicle 24 is provided by a vehicle access door 214 (FIG. 1).

Additional shell storage capacity may be provided in drum 186 by providing a second circle of shell holding apertures 216 inwardly of the circle of apertures 198 (FIG. 7), five such inner apertures 216 being shown. Similarly, an inner circle of five shell holding apertures 218 may be provided in second drum 188. Shells 30 stored in apertures 216 and 218 are manually removed, by access through door 214, and are manually loaded into outer apertures 198 and/or 200 from which shells have been transferred, in the above described manner, into canisters 56 of primary magazine portion 40.

Figure 3:
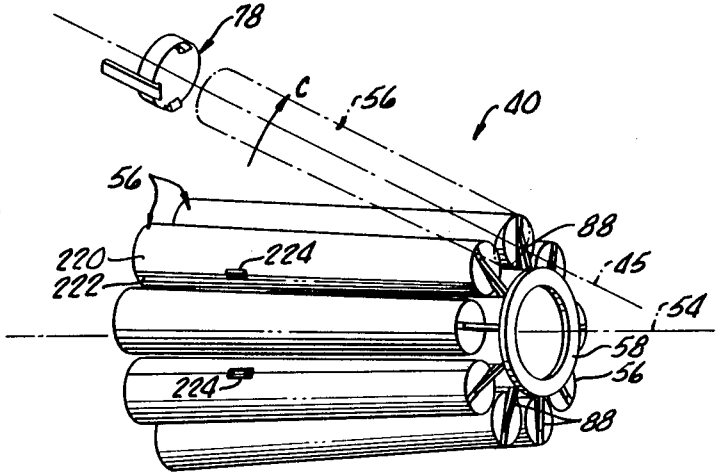
FIG. 3 is a perspective drawing of a primary portion of the magazine apparatus of the present invention showing major components thereof.

Provision may alternatively or additionally be made for the manual loading of shells 30 into primary magazine canisters 56. If, as will ordinarily not be the case, sufficient space is provided in gun crew basket rearwardly of primary magazine portion 40, shells 30 can be manually inserted directly into rearward ends of canisters with no additional provisions being necessary. In the likely event that such rearward space does not exist, each canister 56 may be longitudinally slit, for a substantial distance, into upper and lower canister "clamshell" segments 220 and 222 (FIG. 3). Preferably segments 220 and 222 are hinged along one edge and are formed having a manually releasable latch or lock 224 on the other side edge. Orientation of segments 220 and 222 of each canister 56 is such that in at least one rotational position of canister carrier 58, upper segment 220 of at least one canister 56 can be opened sufficiently to permit insertion of a shell 30 into the canister. Thus by repeated indexing of canister carrier 58 (by Geneva drive means 170) all canisters 56 can be manually reloaded with shells 30 stored in gun crew basket 26 or elsewhere in vehicle 24.

Figure 2:
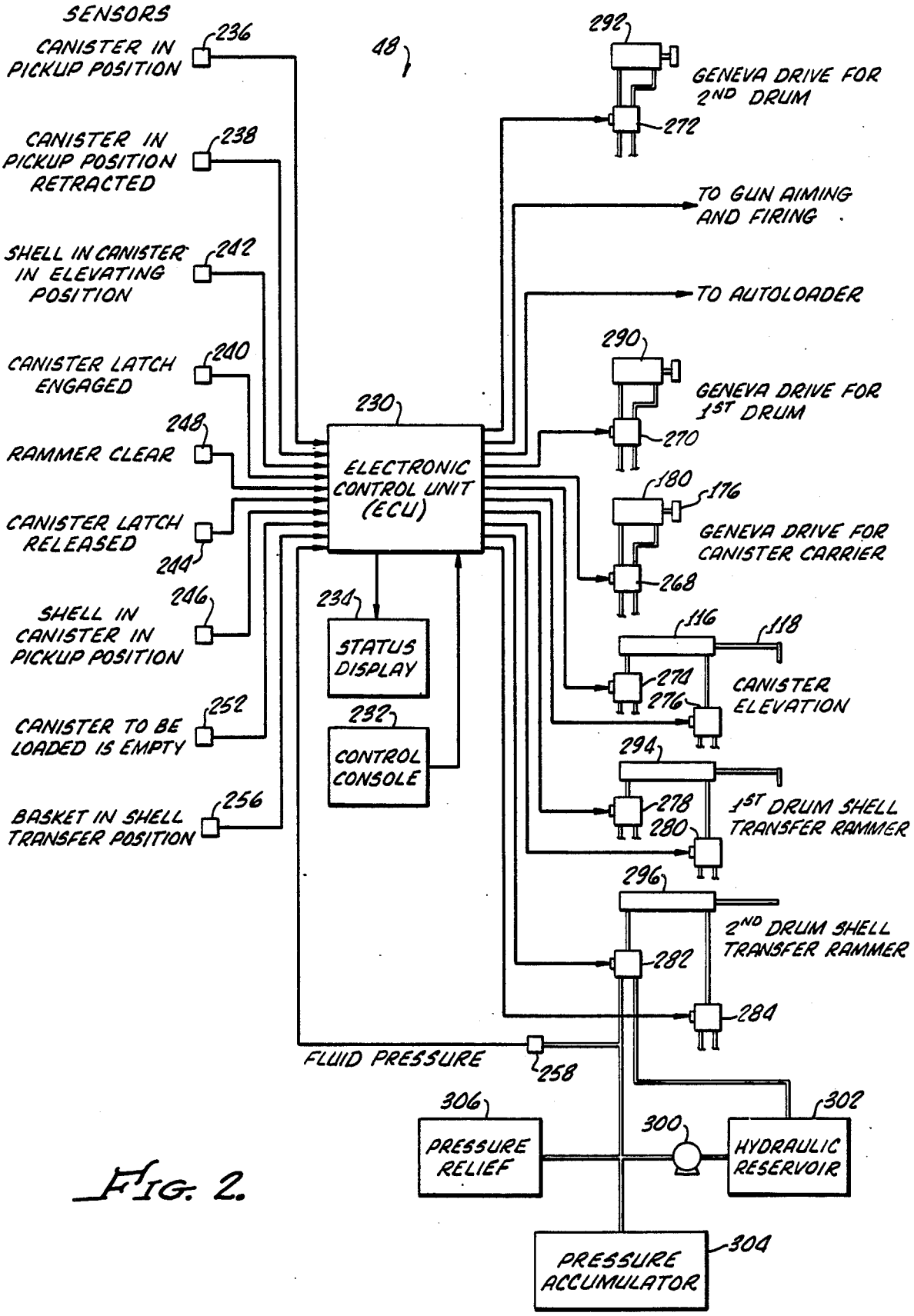
FIG. 2 is a schematic drawing showing sensor and control portions of the magazine apparatus.

Sensor and control means 48, as depicted in FIG. 2, comprise generally an electronic control unit (ECU) 230 which is operatively connected to a plurality of electrically operated, pressurized fluid control valves and to which is operatively connected a number of weapon system sensors. As such, ECU 230 may be responsible for controlling operation of the entire weapons system of which magazine apparatus 28 of the present invention is only a portion. Other portions of the overall weapons system which may also be operated by ECU 230 include automated shell loading means 34 and aiming of cannon 32 (FIG. 1). Shown electrically connected to ECU 230 are a control console box 232 by means of which a gun operator can input commands to the ECU, and status display box 234 by means of which status of the weapons system may be displayed to a gun operator. In response to such commands as "LOAD" received from control console box 232, ECU 230 checks system status as provided by various of the sensors and, in accordance with internal programming associated with the command received, the ECU causes operation of the electrically controlled valves in a predetermined sequence required for executing the command.

General configuration and operation of sensor and control means 48 is similar to that disclosed in U.S. patent application Ser. No. 608,768 filed on May 10, 1984 and titled "Electronically Controlled, Externally Powered Automatic Gun", which is hereby incorporated herein in its entirety.

More specifically, sensor and control means 48 may comprise the following sensors which relate, directly or indirectly, to operation of magazine apparatus 28 of the present invention: "canister in pickup position" sensor 236, "retracted canister in elevating position" sensor 238, "canister in elevating positon latched" sensor 240, "shell in canister in elevating position" sensor 242, "canister in elevating position unlatched" sensor 244, "shell in canister in pickup position" sensor 246, "shell pickup rammer is clear" sensor 248, "canister to be loaded is empty" sensor 252, "basket in shell transfering position" sensor 256 and "fluid pressure" sensor 258. The function of each such above-mentioned sensor is generally evident from its title. However, by way of specific example, canister in pickup position sensor 236 provides an electric signal to ECU 230 when one of the canisters 56 is elevated into pickup position 36, and shell in canister in pickup position sensor provides an electric signal to the ECU when a canister in the pickup position has a shell in it, both such signals providing a "go ahead" to operation of shell loading means 34.

Based on the appropriate weapon system components being in the current position at the correct time, ECU 230 proceeds with causing execution, on a step-by-step, go-no go basis, of the specific command received from control console 232, in the manner described in detail in the above referenced patent application Ser. No. 608,768.

ECU 230 is, therefore, electrically connected to such solenoid fluid control valves as: canister carrier Geneva drive valve 268, first drum Geneva drive valve 270, second drum Geneva drive valve 272, canister elevating valve 274, canister retracting valve 276, first drum rammer advance valve 278, first drum rammer retract valve 280, second drum rammer advance valve 282 and second drum rammer retract valve 284. Valve 268 is connected for providing operating pressure to drive Geneva drive motor 180; valve 270 is connected for providing operating pressure to drive a Geneva drive motor 290 and valve 272 is connected for providing operating pressure to drive a Geneva drive motor 292. Valves 274 and 276 are connected to supply operating pressure to canister unlatching and elevating cylinder 116. Valves 278 and 280 are connected to supply operating pressure to a first rammer cylinder 294 and valves 282 and 284 are connected to supply operating pressure to a second rammer cylinder 296.

Presurized fluid, preferably hydraulic fluid, is provided to solenoid valves 268–284 by a pump 300 which is connected to a fluid reservoir 302. Connected downstream of pump 302 may be a pressure accumulator 364 and a pressure relief valve or diaphragm 306. ECU 230 may also control other operations such as elevational movement of cannon 32, opening and closing of breech 38 and shell loading by means 34 according to particular gun, breech and loader configuration. As such ECU 230 may, in fact, comprise portions of an on-board fire control computer (not shown).

Status display 234 may be provided to visually display weapon system status, such as "gun loaded" to gun crew members, and may, as well, be used to display weapon system diagnostic malfunction information.

Although operation of magazine aperture 28 is generally discussed above in conjuntion with the description of primary and secondary magazine portions 40 and 42, the following example of one phase of operation is provided. When a LOAD command is provided from control console box 232 to ECU 230, the ECU may first check the input from sensors 236 and 246 to determine whether a canister 56 is in pickup position 36 and, if so, whether a shell 30 is in such canister. If a shell 30 is present in pickup position 36, ECU checks inputs from sensors (not shown) associated with shell loading means 34 and if necessary conditions are satisfied, the ECU causes operation of the loading means. Assuming, however, sensor 236 indicates that no canister 56 is in pickup position 236 and sensor 242 indicates that no shell is present in the canister in the elevating position, it is then required, to enable loading of cannon 32, that canister carrier 58 to rotatably indexed, by Geneva drive means 170, one or more times to bring a loaded canister 56 to the canister elevating position. Such indexing is provided by operation of valve 268, which supplies pressurized fluid to drive motor 180 of Geneva drive means 170, by ECU 230 after the ECU checks sensor 248 to make certain rammer portions of shell loading apparatus 34 are clear.

After sensor 242 indicates that a loaded canister 56 is in the elevating position, ECU 230 operates valve 274 so as to supply pressurized fluid to elevating cylinder 116, thereby causing unlatching of the canister from carrier 58 and then elevating the canister into pickup position 36. At this point, ECU initiates operation of shell loading apparatus 34. If, however, at any time fluid pressure sensor 258 indicates a lack of sufficient operating presure, ECU 230 interrupts execution of the command and preferably causes a predetermined failure signal, such as "LOW OPERATING PRESSURE" to be displayed in status display box 234.

Other operations of magazine apparatus 28 are executed in a similar manner.

It is to be appreciated that sensor and control means 48 can, additionally, be configured for providing, upon demand from control console box 232, different types of shells 30 to pickup position 36. In such case, each canister 56 would be provided with a "shell-type" sensor (not shown) that would provide information to ECU 230 as to the type of shell in each canister (by canister number). When a particular type of shell 30 is demanded, for loading, ECU 230 would scan the shell-type sensors and determine which canister or canisters 56 contain the required shell type and would then cause incremental rotation of carrier 58 until a canister containing the required type of shell is indexed into the elevating position.

Although there has been described above a particular embodiment of shell magazine apparatus according to the present invention to illustrate the manner in which the invention may be used to advantage, it is to be appreciated that the invention is not limited thereto. Thus any and all variations, modifications and alternative arrangements as may occur to those skilled in the art are to be considered to be within the scope of the invention as defined in the appended claims.

What is claimed is:

1. Shell magazine apparatus for a vehicle having rotatably mounted therein a gun crew basket to which a cannon is externally mounted for azimuthal rotation therewith, said cannon being mounted to said basket so as to permit cannon barrel elevational movement, said magazine apparatus comprising:

(a) a primary shell magazine having a plurality of shell-holding canisters and a canister carrier, having means for pivotally mounting forward ends of each of the canisters to a forward end of the carrier for pivotal movement between a first, retracted position and a second, elevated position and having means for releasably latching the canisters in the first, retracted position;

(b) means for rotatably mounting said canister carrier in said gun crew basket;

(c) means for causing rotation of said canister carrier so as to enable said canisters to be rotated, one at a time, into a specific rotational, elevating position;

(d) means for unlatching whichever one of the canisters is rotated into said specific rotational elevational position, and for thereafter elevating the unlatched canister to the second, elevated position from which a shell contained in said elevated position can be extracted by an associated gun loading apparatus;

(e) a secondary shell magazine disposed in said vehicle outside of said gun crew basket so as not to rotate with said basket and primary shell magazine; and (f) means for automatically transferring shells from said secondary magazine forwardly into rearward ends of the primary shell magazine canisters when the gun crew basket is rotated to a preselected azimuthal position in which a shell transfer position of the secondary loading magazine is aligned with a selected canister position of the primary shell magazine.

2. The shell magazine apparatus as claimed in claim 1 wherein the means for rotatably mounting the canister carrier beneath the cannon and in the gun crew basket mounts said carrier for rotation about an axis which is in the elevational plane defined by the bore axis of the barrel of said cannon as the barrel is elevated relative to the gun crew basket.

3. The shell magazine apparatus as claimed in claim 1 wherein said secondary shell magazine includes first and second, similar shell holding cylinders, each of the cylinders having a plurality of shell-holding ports located on a common circle and including means for mounting each of said cylinders in a side-by-side relationship on laterally separated longitudinal axes, the longitudinal mounting axis of the first cylinder being at the center of the circle on which the first cylinder ports are located and the longitudinal axis of the second cylinder being at the center of the circle on which the second cylinder ports are located.

4. The shell magazine apparatus as claimed in claim 3 wherein each of said first and second cylinders has a separate, specific shell transferring rotational position from which shells from cylinder ports rotated into said shell transferring position can be transferred into canisters rotated into a particular, corresponding canister position of the primary magazine when said canisters are rotated into said transferring positions.

5. The shell magazine apparatus as claimed in claim 4 wherein at least one of the first and second cylinders is formed having a second circle of shell-holding ports located inwardly from the first mentioned shell holding ports and therefore inwardly of the cylinder shell transfer position.

6. The shell magazine apparatus as claimed in claim 3 including means for causing rotational movement of the first and second cylinders so as to enable each of the shell-holding ports of each cylinder to be moved into the shell transferring position associated therewith.

7. The shell magazine apparatus as claimed in claim 1 wherein at least one of said canisters is longitudinally split into upper and lower clamshell segments and including means for enabling manual opening of said upper segment relative to said lower segment so as to enable the manual loading of a shell into said longitudinally split canister.

8. The shell magazine apparatus as claimed in claim 7 wherein each of said canisters is longitudinally split into upper and lower clamshell segments, said manual opening means enabling the opening of each said upper segment relative to the corresponding lower segment so as to enable the manual loading of shells into each said canister.

9. Shell magazine apparatus for guns, which comprises:

(a) a plurality of shell holding canisters, each of said canisters having a shell base end and a shell projectile end;

(b) a canister carrier and means for pivotally mounting the canisters thereto on a common circle and in a mutually spaced apart, side-by-side relationship;

(c) means for mounting the canister carrier for rotation about a central rotational axis;

(d) means for causing incremental rotation of said canister carrier about said rotational axis so as to enable each of the canisters to be indexed, in turn, into a preselected canister pivoting position; and (e) means for causing pivoting of whichever canister is indexed into said pivoting position between a normal, retracted position and an elevated, shell extraction position, said canister pivoting means including a plurality of pivot arms, one of the pivot arms being fixed to the shell projectile end of each of the canisters, the pivot arms rotating with the canisters as the canister carrier rotates.

10. Shell magazine apparatus for guns, which comprises:

(a) a plurality of elongate, tubular shell holding canisters, each canister being configured for holding one shell and each having a substantially open shell base end and an at least partially closed shell projectile end;

(b) canister carrier means including a core, a canister carrier, and means for mounting the carrier for rotation about the core;

(c) means for pivotally mounting shell projectile ends of the canisters to the canister carrier for pivotal movement of each canister between a retracted position and an elevated position;

(d) means for releasably locking the canisters to the carrier in the retracted position;

(e) means for incrementally rotating the canister carrier about a rotational axis through the core so as to enable each of the canisters to be indexed, in turn, into a specific canister elevating position; and (f) means for causing the pivoting of whichever one of the canisters is indexed into the elevating position between a normal, retracted position and an elevated position in which a shell in the elevated canister is in a position to be picked up by an associated shell loading apparatus, said canister pivoting means including a plurality of pivot arms, one of the pivot arms being fixed to the shell projectile end of each of the canisters, the pivot arms rotating with the canisters as the canister carrier rotates.

11. The shell magazine apparatus as claimed in claims 9 or 10 wherein the canister pivoting means include a fluid pressure cylinder and a piston moved, by fluid pressure in the cylinder, between an extended and a retracted position, and including a slide connected to the piston, said slide having means for engaging the pivot arm of whichever one of the canisters is rotatably indexed into the canister pivoting position.

* * * * *